US012251068B2

(12) United States Patent
Durham et al.

(10) Patent No.: US 12,251,068 B2
(45) Date of Patent: Mar. 18, 2025

(54) SYSTEMS FOR LIQUID DIVERSION IN APPLIANCES

(71) Applicant: Haier US Appliance Solutions, Inc., Wilmington, DE (US)

(72) Inventors: Kyle Edward Durham, Louisville, KY (US); Christopher Brandon Ross, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 457 days.

(21) Appl. No.: 17/693,720

(22) Filed: Mar. 14, 2022

(65) Prior Publication Data

US 2023/0284861 A1 Sep. 14, 2023

(51) Int. Cl.
*A47L 15/42* (2006.01)

(52) U.S. Cl.
CPC ..... *A47L 15/4221* (2013.01); *A47L 15/4225* (2013.01)

(58) Field of Classification Search
CPC ..... A47L 15/4221; A47L 15/4225
See application file for complete search history.

(56) References Cited

U.S. PATENT DOCUMENTS

| | | | | |
|---|---|---|---|---|
| 9,307,886 | B2 | 4/2016 | Durham et al. | |
| 9,980,624 | B2 | 5/2018 | Hofmann et al. | |
| 10,206,553 | B2 * | 2/2019 | Ross | A47L 15/4225 |
| 10,512,387 | B2 * | 12/2019 | Ross | A47L 15/4293 |
| 11,739,851 | B2 * | 8/2023 | Krieger | F16K 11/0856 68/3 R |
| 2015/0101644 | A1 * | 4/2015 | Durham | A47L 15/4221 134/184 |
| 2015/0230687 | A1 | 8/2015 | Dries et al. | |
| 2017/0027406 | A1 * | 2/2017 | Durham | A47L 15/4221 |
| 2017/0071441 | A1 * | 3/2017 | Durham | F16K 31/52483 |
| 2017/0071442 | A1 * | 3/2017 | Boyer | F16K 11/074 |
| 2017/0071443 | A1 * | 3/2017 | Boyer | F16K 11/074 |
| 2017/0071444 | A1 * | 3/2017 | Hofmann | A47L 15/4221 |
| 2018/0084967 | A1 * | 3/2018 | Ross | A47L 15/4221 |
| 2018/0092506 | A1 * | 4/2018 | Ross | A47L 15/4221 |

FOREIGN PATENT DOCUMENTS

| | | | |
|---|---|---|---|
| JP | 2011224232 | A | 11/2011 |
| WO | WO2017218113 | A1 | 12/2017 |

* cited by examiner

*Primary Examiner* — Benjamin L Osterhout
(74) *Attorney, Agent, or Firm* — Dority & Manning, P.A.

(57) ABSTRACT

A diverter assembly for a dishwasher appliance includes a housing and a cam sleeve with a plurality of passages. The cam sleeve defines a first portion of a plurality of cam teeth. The diverter assembly also includes a diverter plate rotatably mounted within the housing, and the diverter plate includes a plurality of passages and a plurality of guide teeth. Additionally, the diverter assembly includes a cam post coupled to the housing at the cam sleeve. The cam post defines a second portion of the plurality of cam teeth such that the cam sleeve and the cam post collectively form the plurality of cam teeth. The plurality of cam teeth mesh with the plurality of guide teeth at the central passage of the housing such that the diverter plate rotates relative to the housing when the diverter plate vertically translates within the housing.

19 Claims, 6 Drawing Sheets

SYSTEMS FOR LIQUID DIVERSION IN APPLIANCES

FIELD OF THE INVENTION

The present subject matter relates generally to fluid diverters in appliances.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including, e.g., a lower spray arm assembly mounted to the tub at a bottom of the wash compartment, a mid-level spray arm assembly mounted to one of the rack assemblies, and/or an upper spray assembly mounted to the tub at a top of the wash compartment.

Certain dishwashing appliances use a device, referred to as a diverter, to control the flow of fluid in the dishwashing appliance. For example, the diverter can be used to selectively control which spray assemblies receive a flow of fluid. Known diverters use an electrically powered motor to rotate an element between different ports for fluid control. However, the motor adds a significant expense to the overall manufacturing cost of the dishwashing appliance and must be separately controlled during cleaning operations so that the proper flow is occurring. Hydraulically actuated fluid diverters can operate without a motor. However, known hydraulically actuated fluid diverters are difficult to manufacture.

BRIEF DESCRIPTION OF THE INVENTION

Aspects and advantages of the invention will be set forth in part in the following description, or may be apparent from the description, or may be learned through practice of the invention.

In one example embodiment, a diverter assembly for a dishwasher appliance includes a housing. The housing includes a cam sleeve and defines a plurality of passages. The cam sleeve defines a first portion of a plurality of cam teeth. The diverter assembly also includes a diverter plate rotatably mounted within the housing, The diverter plate includes at least one passage and a plurality of guide teeth. Further, the diverter plate defines a central passage along an axial direction. Additionally, the diverter assembly includes a cam post coupled to the housing at the cam sleeve. The cam post defines a second portion of the plurality of cam teeth such that the cam sleeve and the cam post collectively form the plurality of cam teeth. The plurality of cam teeth mesh with the plurality of guide teeth at the central passage of the housing such that the diverter plate rotates relative to the housing when the diverter plate vertically translates within the housing.

In another example embodiment, a diverter assembly for an appliance includes a housing. The housing includes a sleeve and defines a plurality of passages. The sleeve defines a first portion of a plurality of teeth. The diverter assembly also includes a diverter plate rotatably mounted within the housing, The diverter plate includes at least one passage and a plurality of guide teeth. Further, the diverter plate defines a central passage along an axial direction. Additionally, the diverter assembly includes a post coupled to the housing at the sleeve. The post defines a second portion of the plurality of teeth such that the sleeve and the post collectively form the plurality of teeth. The plurality of teeth mesh with the plurality of guide teeth at the central passage of the housing such that the diverter plate rotates relative to the housing when the diverter plate vertically translates within the housing.

In another example embodiment, a diverter assembly for an appliance includes a housing that defines a plurality of outlet ports and a chamber. The chamber includes a fluid inlet and a fluid outlet to supply fluid to the outlet ports. The housing includes a cam sleeve which defines a first portion of a plurality of cam teeth. The diverter assembly also includes a diverter plate positioned within the chamber and rotatable about an axis. The diverter plate defines an aperture for selectively controlling fluid flow from the chamber through one of the outlet ports. The diverter plate being movable along an axis between a first position and a second position. Additionally, the diverter plate includes a plurality of guide teeth, and the diverter plate includes a flange extending around the diverter plate and projecting along an axial direction towards the fluid outlet. The flange positioned such that fluid flow through the chamber impacts the flange and momentum provided by the fluid flow urges the diverter plate towards the second position. Further included in the diverter assembly is a spring coupled to the diverter plate, configured to urge the diverter plate towards the first position. The diverter assembly also includes a cam post coupled to the housing at the cam sleeve. The cam post defines a second portion of the plurality of cam teeth such that the cam sleeve and the cam post collectively form the plurality of cam teeth. The plurality of cam teeth mesh with the plurality of guide teeth at the central passage of the housing such that the diverter plate rotates relative to the housing when the diverter plate translates within the housing between the first and second positions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
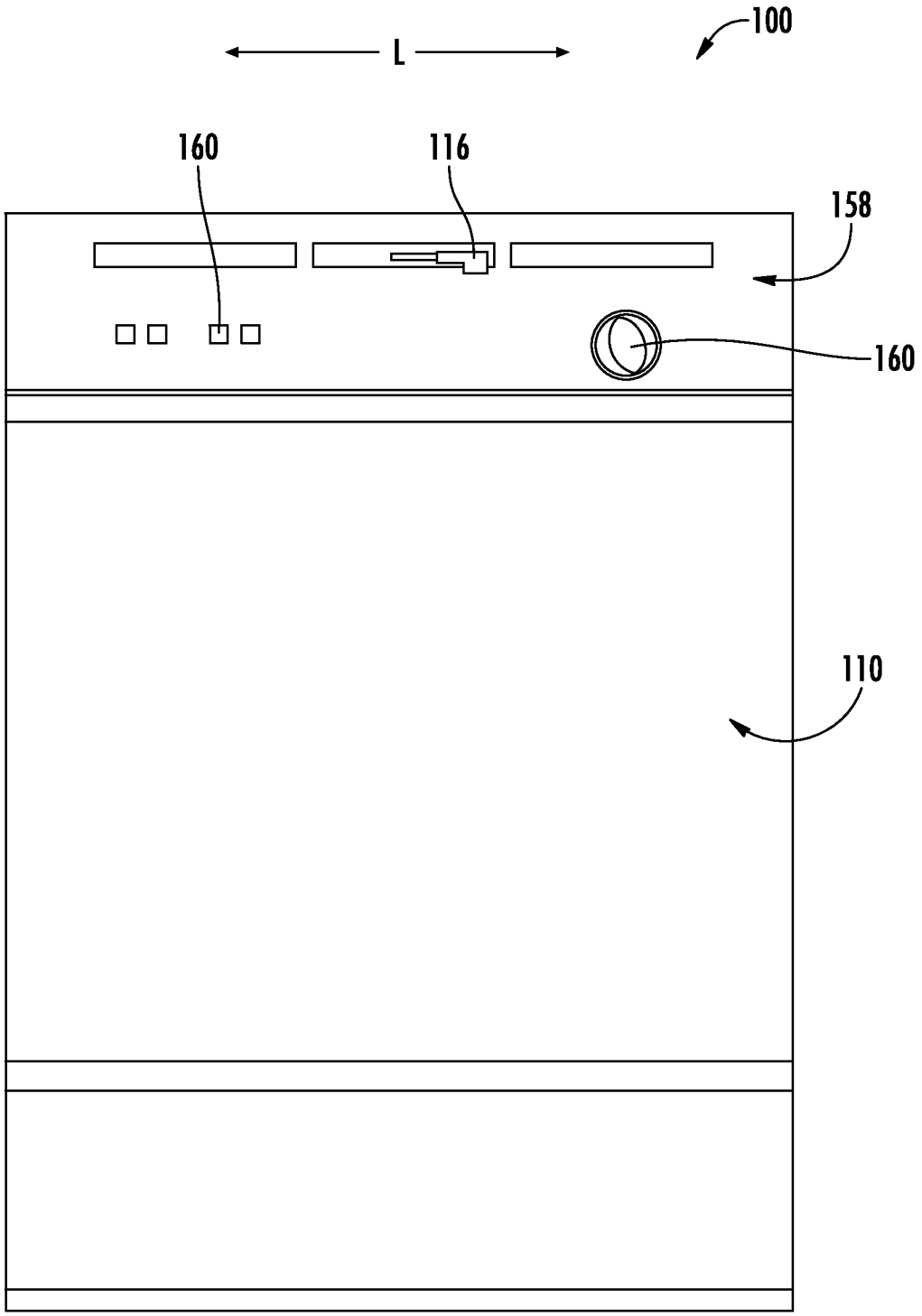
FIG. 1 provides a front view of a dishwashing appliance as an example embodiment of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the present disclosure, one or more examples of which are illustrated in the drawings. Each example is provided by way of explanation, not limitation of the disclosure. In fact, it will be apparent to those skilled in the art that various modifications and variations can be made in the present invention without departing from the scope or spirit of the disclosure. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments. The use of the terms "top" and "bottom," or "upper" and "lower" herein are used for reference only as example embodiments disclosed herein are not limited to the vertical orientation shown nor to any particular configuration shown; other constructions and orientations may also be used.

Figure 2:
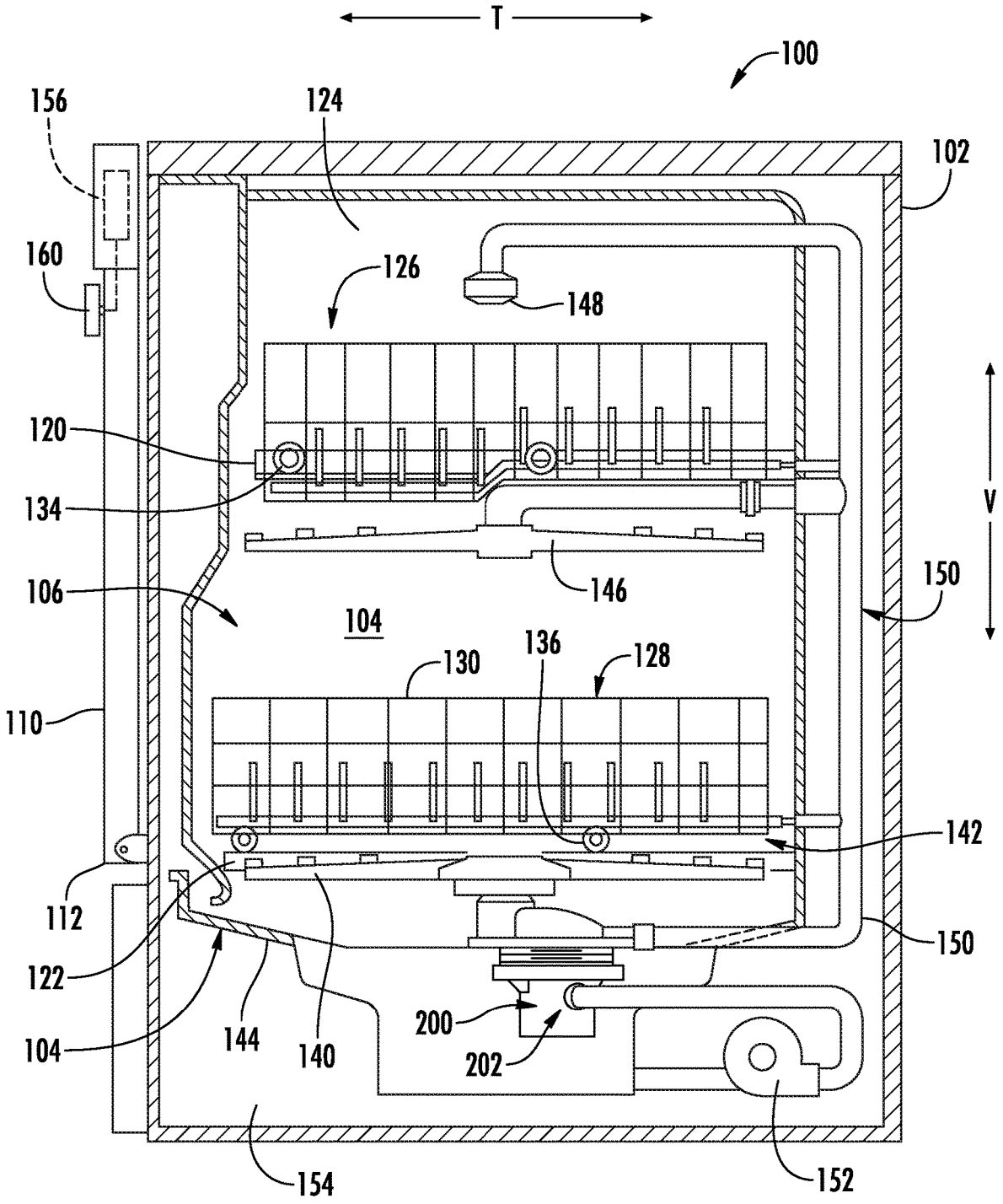
FIG. 2 provides a side cross sectional view of the example dishwashing appliance of FIG. 1.

FIGS. 1 and 2 depict an example dishwasher 100 that may be configured in accordance with aspects of the present disclosure. For the shown example embodiment of FIGS. 1 and 2, the dishwasher 100 includes a cabinet 102 having a tub or inner liner 104 therein that defines a wash chamber 106. The tub 104 includes a front opening (not shown) and a door 110 hinged at its bottom 112 for movement between a normally closed vertical position (shown in FIGS. 1 and 2), wherein the wash chamber 106 may be sealed shut for washing operation, and a horizontal open position for loading and unloading of articles from the dishwasher 100. Latch 116 may be used to lock and unlock door 110 for access to chamber 106.

Upper and lower guide rails 120, 122 may mount on tub side walls 124 and accommodate roller-equipped rack assemblies 126 and 128. Each of the rack assemblies 126, 128 may be fabricated into lattice structures including a plurality of elongated members 130 (for clarity of illustration, not all elongated members making up assemblies 126 and 128 are shown in FIG. 2). Each rack 126, 128 is adapted for movement between an extended loading position (not shown) in which the rack is substantially positioned outside the wash chamber 106, and a retracted position (shown in FIGS. 1 and 2) in which the rack is located inside the wash chamber 106. The movement of each rack 126 and 128 may be facilitated by rollers 134 and 136, for example, mounted onto racks 126 and 128, respectively. A silverware basket (not shown) may be removably attached to rack assembly 128 for placement of silverware, utensils, and the like, that are otherwise too small to be accommodated by the racks 126, 128.

The dishwasher 100 further includes a lower spray-arm assembly 140 that is rotatably mounted within a lower region 142 of the wash chamber 106 and above a tub sump portion 144 so as to rotate in relatively close proximity to rack assembly 128. A mid-level spray-arm assembly 146 is located in an upper region of the wash chamber 106 and may be located in close proximity to upper rack 126. Additionally, an upper spray assembly 148 may be located above the upper rack 126.

The lower and mid-level spray-arm assemblies 140, 146 and the upper spray assembly 148 are part of a fluid circulation assembly 150 for circulating water and dishwasher fluid in the tub 104. The fluid circulation assembly 150 also includes a pump 152 positioned in a machinery compartment 154 located below the tub sump portion 144 (i.e., bottom wall) of the tub 104, as generally recognized in the art. Pump 152 receives fluid from sump 144 and provides a flow to the inlet 202 of a diverter, such as diverter assembly 200, as more fully described below.

Each spray-arm assembly 140, 146 may include an arrangement of discharge ports or orifices for directing washing liquid received from diverter assembly 200 onto dishes or other articles located in rack assemblies 126 and 128. The arrangement of the discharge ports in spray-arm assemblies 140, 146 provides a rotational force by virtue of washing fluid flowing through the discharge ports. The resultant rotation of spray-arm assemblies 140, 146 and the operation of spray assembly 148 using fluid from diverter assembly 200 provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

Each spray assembly may receive an independent stream of fluid, may be stationary, and/or may be configured to rotate in one or both directions. For example, a single spray arm may have multiple sets of discharge ports, each set receiving wash fluid from a different fluid conduit, and each set being configured to spray in opposite directions and impart opposite rotational forces on the spray arm. In order to avoid stalling the rotation of such a spray arm, wash fluid is typically only supplied to one of the sets of discharge ports at a time.

Dishwasher 100 is further equipped with a controller 156 to regulate operation of the dishwasher 100. The controller 156 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 156 may be positioned in a variety of locations throughout dishwasher 100. In the illustrated embodiment, controller 156 may be located within a control panel area 158 of door 110 as shown in FIGS. 1 and 2. In such an embodiment, input/output ("I/O") signals may be routed between the control system and various operational components of dishwasher 100 along wiring harnesses that may be routed through the bottom 112 of door 110. Typically, controller 156 includes a user interface panel/controls 160 through which a user may select various operational features and modes and monitor progress of the dishwasher 100. In one embodiment, user interface 160 may represent a general purpose I/O ("GPIO") device or functional block. In one embodiment, user interface 160 may include input components, such as one or more of a variety of electrical, mechanical or electro-mechanical input devices including rotary dials, push buttons, and touch pads. User interface 160 may include a display component, such as a digital or analog display device designed to provide operational feedback to a user. User interface 160 may be in communication with controller 156 via one or more signal lines or shared communication busses. It should be appreciated that the invention is not limited to any particular style, model, or configuration of dishwasher 100. The example embodiment depicted in FIGS. 1 and 2 is for illustrative purposes only. For example, different locations may be provided for user interface 160, different configurations may be provided for racks 126, 128, different spray arm assemblies 140, 146, 148 may be used, and other differences may be applied as well.

Figure 3:
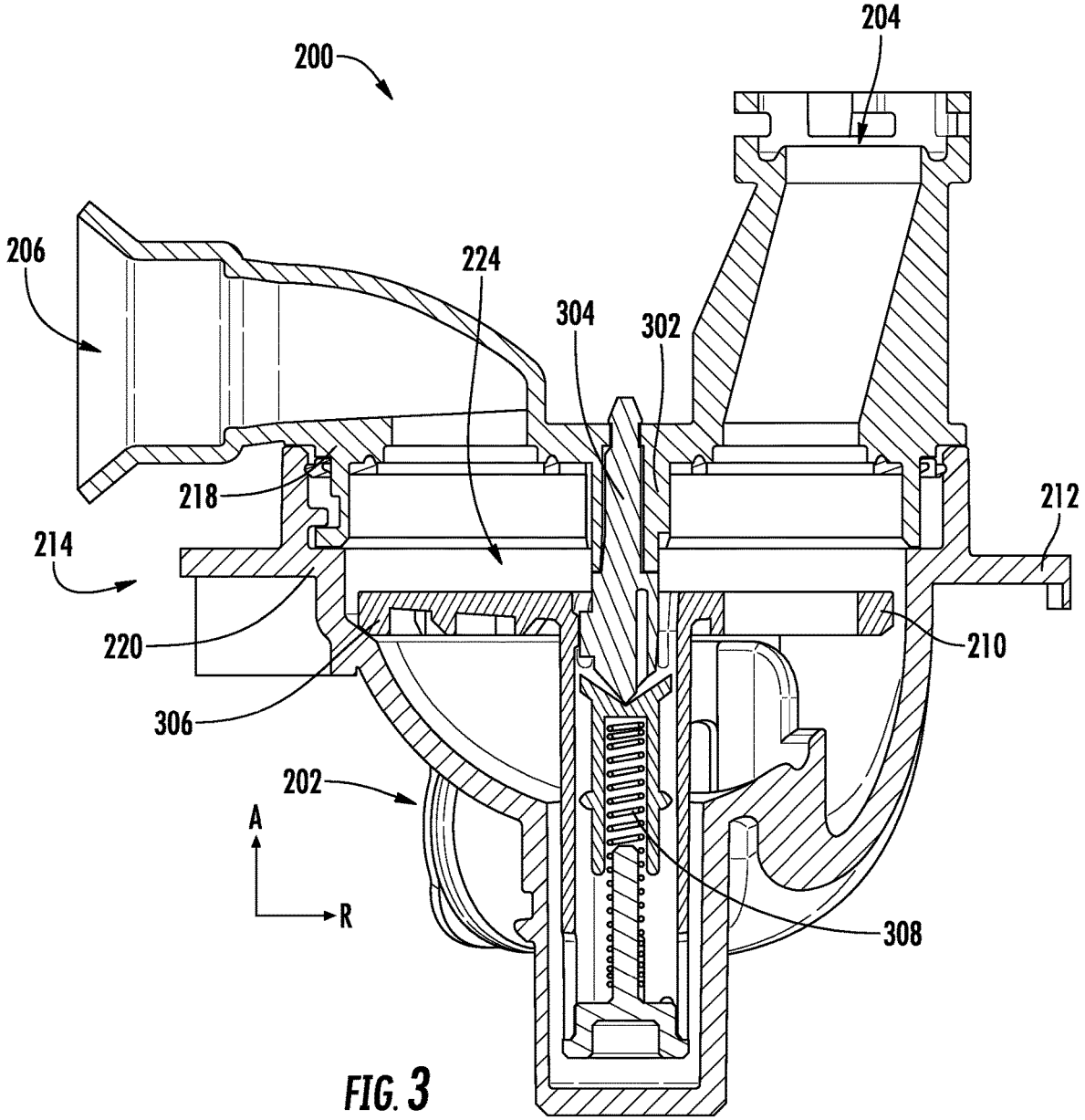
FIG. 3 is a side section view of a diverter assembly as an example embodiment of the present disclosure.
Figure 4:
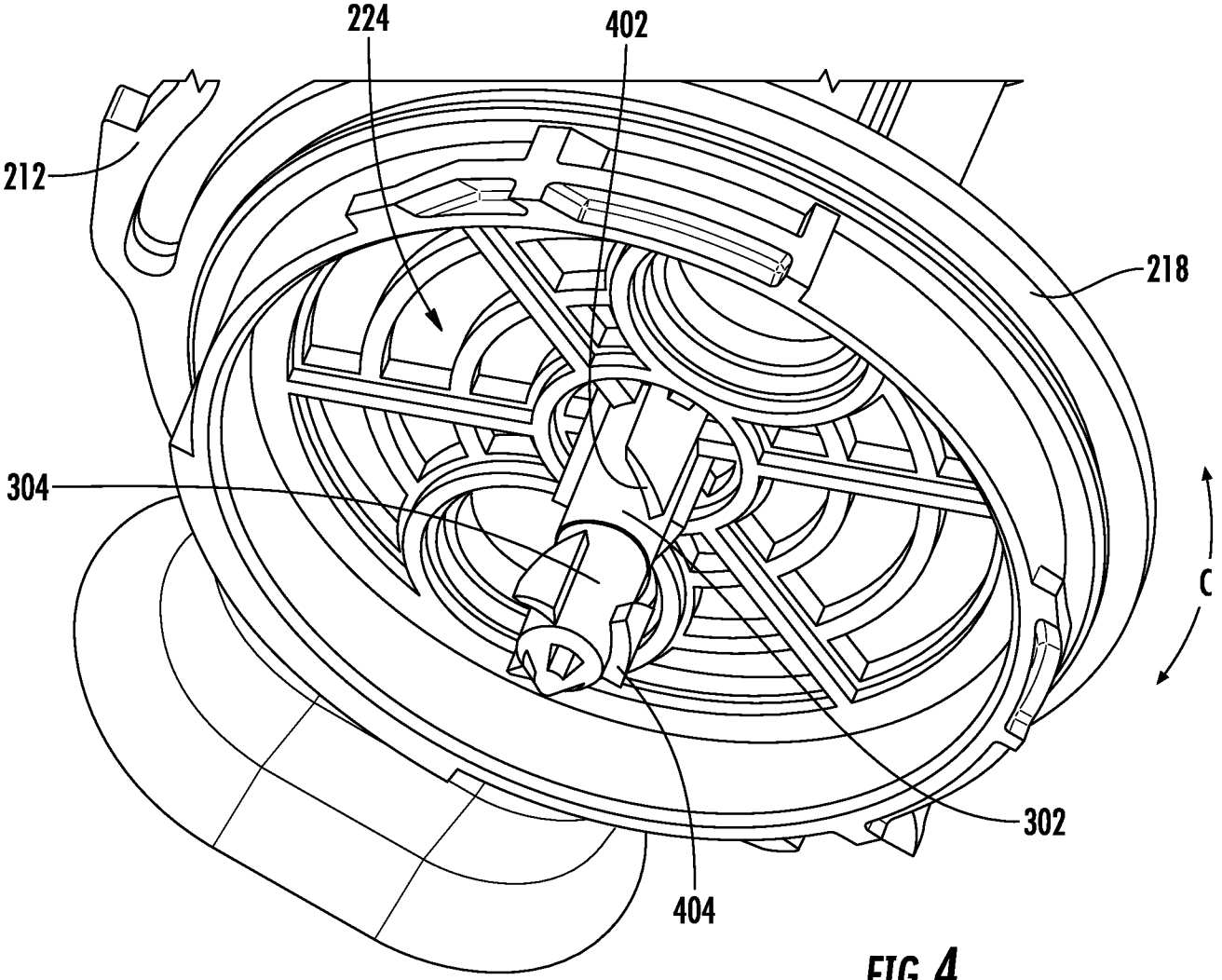
FIG. 4 is an isometric perspective view of the example diverter assembly of FIG. 3.

FIGS. 3 and 4 provide a side section view and a perspective view, respectively, of an example embodiment of a diverter assembly 200. Diverter assembly 200 defines an axial direction A, a radial direction R, and a circumferential direction C (see, e.g., FIGS. 3 and 4). Diverter assembly 200 has a fluid inlet 202 for receiving a flow of fluid from pump 152 that is to be supplied to spray assemblies 140, 146, and/or 148 as well as other fluid-using components during cleaning operations. As stated, pump 152 receives fluid from e.g., sump 144 and provides a fluid flow to diverter assembly 200.

In the present example embodiment, diverter assembly 200 includes a plurality of outlet ports—shown in FIG. 3 and FIG. 4 as first outlet port 204 and a second outlet port 206. In general, other example embodiments may include three, four, or more than four outlet ports which may be used with diverter assembly 200 depending upon e.g., the number of switchable ports desired for selectively placing pump 152 in fluid communication with different fluid-using elements of appliance 100. Diverter assembly 200 includes a diverter plate 210, more fully described below, that can be selectively switched between ports 204 and 206 by hydraulically actuating diverter plate 210.

By way of example, first outlet port 204 can be fluidly connected with upper spray assembly 148 and lower spray arm assembly 140 and second outlet port 206 can be fluidly connected with mid-level spray arm assembly 146. Other spray assemblies and connection configurations may be used as well. As such, the rotation of diverter plate 210 in diverter assembly 200 may be used to selectively place pump 152 in fluid communication with spray assemblies 140, 146, or 148 by way of outlet ports 204 and 206. Diverter assembly 200 also includes multiple apertures 212 that allow for fastening diverter assembly 200 to wash tub 104 at sump 142 (FIG. 2).

Referring still to FIGS. 3 and 4, diverter assembly 200 may be constructed from a housing 214, e.g., that includes a first portion 218 and a second portion 220. A seal (not shown) may provide a fluid seal between the first and second portions 220 of housing 214. Housing 214 may define an interior chamber 224 into which fluid flows from fluid inlet 202. Also, a cam sleeve 302 may be defined by housing 214, e.g., by first portion 218 of housing 210. Cam sleeve 302 defines a central passage for cam post 304. Both cam sleeve 302 and cam post 304 collectively form a plurality of cam teeth. Cam sleeve 302 includes the first portion of cam teeth 402, and cam post 304 includes the second portion of cam teeth 404. Thus, collectively, the plurality of cam teeth 402 and 404 define the overall plurality of cam teeth. The first portion of cam teeth 402 and the second portion of cam teeth 404 may be circumferentially offset, and may have angled faces facing each other, with respect to the axial direction A.

Figure 5:
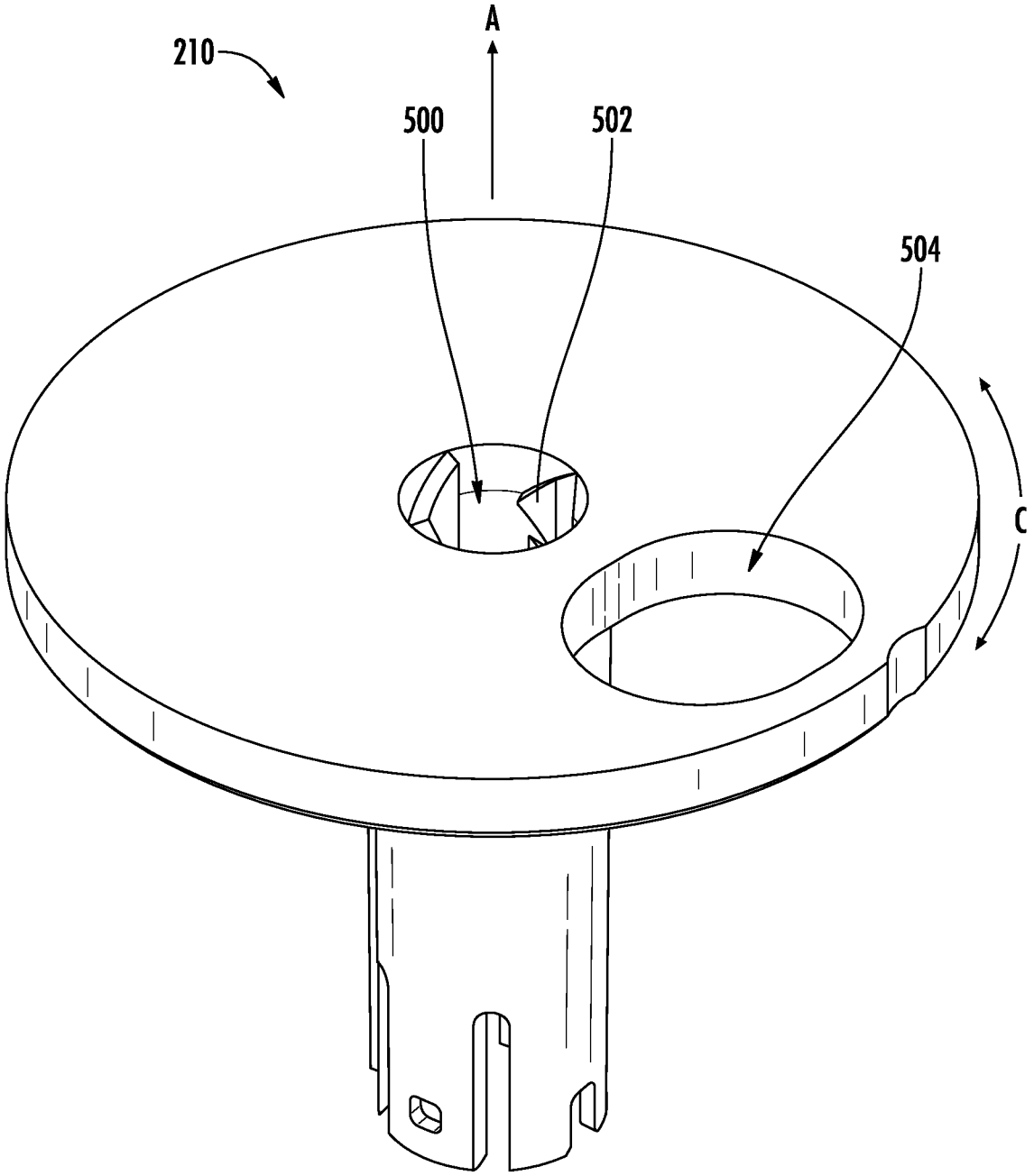
FIG. 5 is an isometric perspective view of the diverter plate of the example diverter assembly of FIG. 3.

Diverter plate 210, as shown in FIG. 5, includes a central passage 500 in the axial direction A as well as an opening, or passage 504. Central passage 500 includes guide teeth 502, and when mounted into housing 214, guide teeth 502 may mesh with and be positioned in between the plurality of cam teeth 402 and 404 of cam sleeve 302 and cam post 304, respectively. The plurality of cam teeth 402, cam teeth 404 and guide teeth 502 may have at least one face positioned at an angle in the range of about thirty degrees to about fifty degrees with respect to the axial direction. The angle of the face on each of the plurality of cam teeth 402, cam teeth 404, and guide teeth 502 may determine the amount of rotation diverter plate 210 rotates when actuated.

When fluid flow enters chamber 224, diverter plate 210 is hydraulically actuated or translated in the axial direction A and/or vertically, meshing guide teeth 502 with the plurality of cam teeth 404 causes diverter plate 210 to rotate as the diverter plate 210 translates in the axial direction A. As stated above, the first portion of cam teeth 402 and the second portion of cam teeth 404 may be circumferentially offset. This offset, along with the angled faces facing each other creates the rotation when the diverter plate is translated in the axial direction A. Referring back to FIG. 3, a spring 308 is disposed in housing 214 which urges diverter plate 210 into a first/normal, or resting, position when fluid flow is slowed or stopped. It will be understood that gravity may also assist with urging diverter plate 210 into the first/normal, or resting, position. Moreover, returning water flow, from after pump 152 is deactivated, may also urge diverter plate 210 into the first position. In another example embodiment, spring 308 may not be included in housing 214, and thus only gravity and/or returning water flow may urge diverter plate 210 into the first/normal, or resting, position.

Further, diverter plate 210 includes a flange 306 to aid in catching momentum from the fluid flow to actuate diverter plate 210 into a second position, executing the rotation. For instance, fluid flow from pump 152 entering housing 214 at inlet 202 may impact against or flow into flange 306 such that the fluid flow urges diverter plate 210 out of or away from the first/normal position. As may be seen from the above, the rotation of diverter plate 210 in diverter assembly 200 may be used to selectively place pump 152 in fluid communication with spray assemblies 140, 146, or 148 by way of outlet ports 204 and 206. Diverter plate 210 may have one or more passages, such as passage 504, spaced circumferentially around diverter plate 210 in order to provide the selective fluid communication mentioned above.

Figure 6:
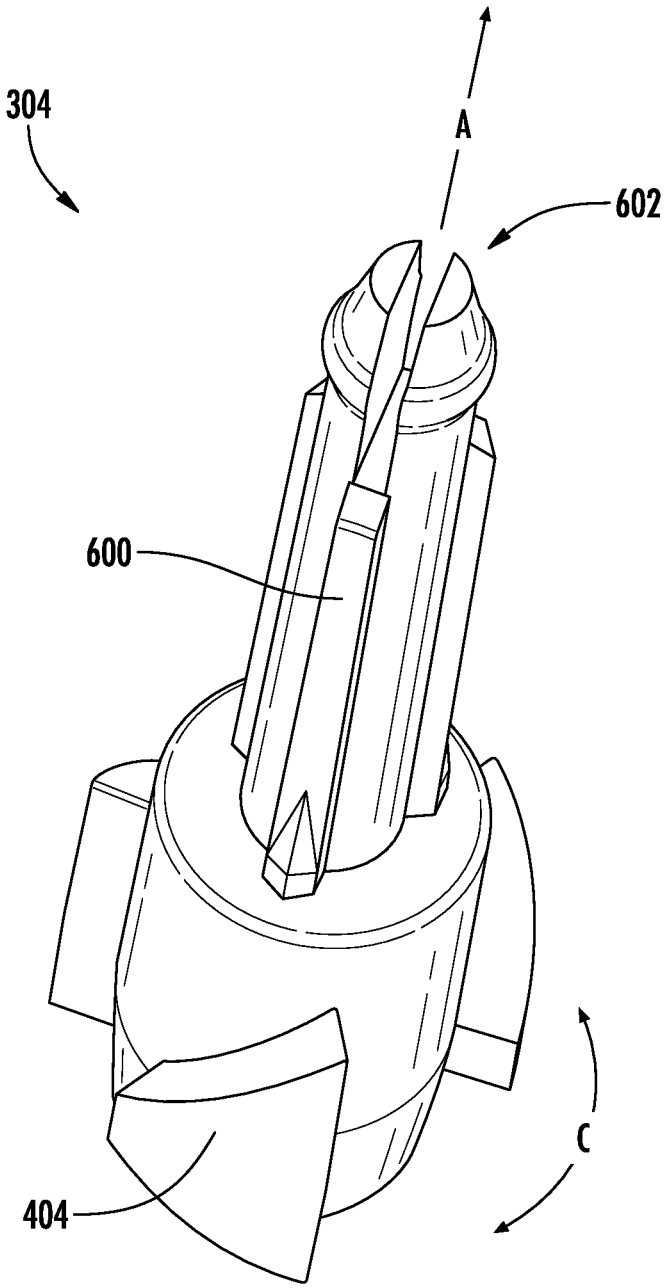
FIG. 6 is an isometric perspective view of the cam post of the diverter assembly of FIG. 3

Referring now to FIG. 6, cam post 304 may be snap-fit, heat staked, pressure-fit, or fastened into cam sleeve 302. As shown in the present example embodiment, cam post 304 is snap-fit into cam sleeve 302 via snap-fit feature 602. Cam post 304 couples to cam sleeve 302 of housing 214 via snap-fit feature 602 located on the top-side of cam post 304 in the axial direction A. Cam teeth 404 may be positioned at the opposite end, or the bottom-side, of cam post 304, with respect to the axial direct A. Cam post 304 includes a keyed portion 600 in order to restrict rotation when mounted in cam sleeve 302. Keyed portion 600 may have at least one key, with a matching slot in cam sleeve 302 to align and restrict rotation. Additional keys may be equidistantly spaced circumferentially around cam post 304.

As may be seen from the above, a diverter assembly 200 includes a cam sleeve 302 and a cam post 304, which each have a plurality of cam teeth, cam teeth 402 and cam teeth 404, respectively. A diverter plate 210 set between the plurality of cam teeth uses a plurality of guide teeth 502 in order to mesh with the plurality of cam teeth 402 and cam teeth 404. Thus, diverter assembly 200 may hydraulically actuate and properly operate within a dishwasher 100. Additionally, diverter assembly 202 may advantageously be easier to manufacture than known diverters because cam sleeve and cam post are two separate pieces. The two-piece assembly addresses problems with the critical geometry related to the function of the diverter. The two-piece assembly may prevent flash along parting lines and allow for adequate tool steel thickness and shut off angles. This makes the diverter manufacturing repeatable and reliable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A diverter assembly for a dishwasher appliance, comprising:

a housing comprising a cam sleeve and defining a plurality of passages, the cam sleeve defining a first portion of a plurality of cam teeth;

a diverter plate rotatably mounted within the housing, the diverter plate comprising at least one passage and a plurality of guide teeth, the diverter plate defining a central passage along an axial direction; and a cam post coupled to the housing at the cam sleeve, the cam post defining a second portion of the plurality of cam teeth such that the cam sleeve and the cam post collectively form the plurality of cam teeth, wherein the plurality of cam teeth mesh with the plurality of guide teeth at the central passage of the diverter plate such that the diverter plate rotates relative to the housing when the diverter plate vertically translates within the housing.

2. The diverter assembly of claim 1, further comprising a spring coupled to the diverter plate, the spring configured to urge the diverter plate towards a normal position.

3. The diverter assembly of claim 1, wherein the passage of the diverter plate selectively aligns with the plurality of passages of the housing when the diverter plate rotates within the housing.

4. The diverter assembly of claim 1, wherein one of the plurality of passages of the housing forms an inlet configured for connecting to a recirculation pump, and another of the plurality of passages of the housing defines an outlet configured for connecting to a spray assembly of the dishwasher appliance.

5. The diverter assembly of claim 1, wherein the cam post is one of snap-fit, heat stake, pressure-fit, and fastened to the housing.

6. The diverter assembly of claim 1, wherein the cam post comprises a keyed projection received within a slot of the housing in order to rotationally fix the cam post with respect to the housing.

7. The diverter assembly of claim 1, wherein both the plurality of guide teeth and the plurality of cam teeth each comprise at least one face positioned at an angle in the range of about thirty degrees to about fifty degrees with respect to the axial direction.

8. A diverter assembly for an appliance, comprising:

a housing comprising a sleeve and defining a plurality of passages, the sleeve defining a first portion of a plurality of teeth;

a diverter plate rotatably mounted within the housing, the diverter plate comprising at least one passage and a plurality of guide teeth, the diverter plate defining a central passage along an axial direction; and a post coupled to the housing at the sleeve, the post defining a second portion of the plurality of teeth such that the sleeve and the post collectively form the plurality of teeth, wherein the plurality of teeth mesh with the plurality of guide teeth at the central passage of the diverter plate such that the diverter plate rotates relative to the housing when the diverter plate vertically translates within the housing.

9. The diverter assembly of claim 8, further comprising a spring coupled to the diverter plate, the spring configured to urge the diverter plate towards a normal position.

10. The diverter assembly of claim 8, wherein the passage of the diverter plate selectively aligns with the plurality of passages of the housing when the diverter plate rotates within the housing.

11. The diverter assembly of claim 8, wherein one of the plurality of passages of the housing forms an inlet configured for connecting to a recirculation pump, and another of the plurality of passages of the housing defines an outlet configured for connecting to a spray assembly of the appliance.

12. The diverter assembly of claim 8, wherein the post is one of snap-fit, heat stake, pressure-fit, and fastened to the housing.

13. The diverter assembly of claim 8, wherein the post comprises a keyed projection received within a slot of the housing in order to rotationally fix the post with respect to the housing.

14. The diverter assembly of claim 8, wherein both the plurality of guide teeth and the plurality of teeth each comprise at least one face positioned at an angle in the range of about thirty degrees to about fifty degrees with respect to the axial direction.

15. A diverter assembly for an appliance comprising:

a housing defining a plurality of outlet ports and a chamber, the chamber comprising a fluid inlet and a fluid outlet to supply fluid to the outlet ports, the housing comprising a cam sleeve, the cam sleeve defining a first portion of a plurality of cam teeth;

a diverter plate positioned within the chamber and rotatable about an axis, the diverter plate defining an aperture for selectively controlling fluid flow from the chamber through one of the outlet ports, the diverter plate movable along the axis between a first position and a second position, the diverter plate comprising a plurality of guide teeth, the diverter plate further comprising a flange extending around the diverter plate and projecting along an axial direction towards the fluid outlet, the flange positioned such that fluid flow through the chamber impacts the flange and momentum provided by the fluid flow urges the diverter plate towards the second position;

a spring coupled to the diverter plate and configured to urge the diverter plate towards the first position; and a cam post coupled to the housing at the cam sleeve, the cam post defining a second portion of the plurality of cam teeth such that the cam sleeve and the cam post collectively form the plurality of cam teeth, wherein the plurality of cam teeth mesh with the plurality of guide teeth such that the diverter plate rotates relative to the housing when the diverter plate translates within the housing between the first and second positions.

16. The diverter assembly of claim 15, wherein the cam post is one of snap-fit, heat stake, pressure-fit, and fastened to the housing.

17. The diverter assembly of claim 15, wherein the cam post comprises a keyed projection received within a slot of the housing in order to rotationally fix the cam post with respect to the housing.

18. The diverter assembly of claim 15, wherein both the plurality of guide teeth and the plurality of cam teeth each comprise at least one face positioned at an angle in the range of about thirty degrees to about fifty degrees with respect to the axial direction.

19. The diverter assembly of claim 15, wherein the diverter plate and spring are configured so that the diverter plate is moved into the second position by fluid flow into the flange and through the fluid outlet of the chamber.

* * * * *